US006109418A

United States Patent [19]

Yost

[11] Patent Number: 6,109,418

[45] Date of Patent: Aug. 29, 2000

[54] TOOL-LESS PARKING METER MECHANISM AND ICON DISPLAY

[75] Inventor: Vincent G. Yost, Harleysville, Pa.

[73] Assignee: Intelligent Devices, Inc., Harleysville, Pa.

[21] Appl. No.: 09/231,718

[22] Filed: Jan. 15, 1999

[51] Int. Cl.[7] ..... G07F 9/10; B65D 43/20

[52] U.S. Cl. ..... 194/350; 220/348

[58] Field of Search ..... 194/217, 350, 194/344, 900; 220/4.21, 4.22, 4.24, 348, 445.3

[56] References Cited

U.S. PATENT DOCUMENTS

| | | | |
|---|---|---|---|
| 3,535,870 | 10/1970 | Mitchell . | |
| 3,999,372 | 12/1976 | Welch et al. . | |
| 4,043,117 | 8/1977 | Maresca et al. . | |
| 4,183,205 | 1/1980 | Kaiser . | |
| 4,823,928 | 4/1989 | Speas . | |
| 4,850,657 | 7/1989 | Placke et al. | 220/4.21 |
| 4,967,895 | 11/1990 | Speas . | |
| 5,407,049 | 4/1995 | Jacobs | 194/217 |
| 5,442,348 | 8/1995 | Mushell . | |
| 5,454,461 | 10/1995 | Jacobs . | |
| 5,570,771 | 11/1996 | Jacobs . | |
| 5,617,942 | 4/1997 | Ward, II et al. | 194/217 |
| 5,634,544 | 6/1997 | Bruner et al. | 194/344 |
| 5,642,119 | 6/1997 | Jacobs . | |
| 5,710,743 | 1/1998 | Dee et al. | 368/90 |
| 5,841,369 | 11/1998 | Sutton et al. . | |
| 5,852,411 | 12/1998 | Jacobs et al. . | |

FOREIGN PATENT DOCUMENTS

| | | | |
|---|---|---|---|
| 617515 | 4/1961 | Canada | 194/350 |

*Primary Examiner*—Robert P. Olszewski
*Assistant Examiner*—Bryan Jaketic
*Attorney, Agent, or Firm*—Caesar, Rivise, Bernstein, Cohen & Pokotilow, Ltd.

[57] ABSTRACT

An electronic parking meter mechanism that can be disassembled and re-assembled by parking authority personnel without the need for tooling. This electronic parking meter mechanism is compatible with any conventional parking meter housing, thereby allowing the device to replace either a mechanical parking meter mechanism or other electronic parking meter mechanisms. In addition, a rugged and secure vehicle detector unit can be electrically coupled to this electronic parking meter mechanism for providing vehicle detection information to the electronic parking meter, thereby allowing the meter to, among other things, reset any unused parking time, while being able to reliably detect the presence or absence of a vehicle in the corresponding parking space. Furthermore, this electronic parking meter utilizes unique and universal symbology for indicating a number of important parking space/meter conditions to both the parking authority personnel, as well as to patrons.

8 Claims, 9 Drawing Sheets

26A
36A
28A
40A
52A
50A
5
38A
50B
52B
35B
5
35A
50C
52C
23
88
86
84
87
72
90
95
82
83
76
24
20
85
78
74
68
70
6
6
36B
28B
40B
26B
38B 22
24
30A
28A
34A
32A
17
17
25
PCB
15
112
110
108
71A
90
75
7
7
120
130
144
71B
72
71C
71D
10
79A
81
12
79B
8
8
132
133
23
98A
44
22
24
20
16

122
118
126
114
127
138
100
98B
144
142
104
136
144
140
134
140
110
113
108
102
106
96
130
44
124
128
120
116
94
98A

TOOL-LESS PARKING METER MECHANISM AND ICON DISPLAY

FIELD OF THE INVENTION

This invention relates generally to the field of parking meters and more particularly to electronic parking meters.

BACKGROUND OF THE INVENTION

Parking meters permit vehicles to be parked on streets for an allowable time determined by the number and denominations of coins which are placed in the parking meter. A clock mechanism in the parking meter runs down the allowable time until it reaches zero, and an overtime parking indication appears. For example, see U.S. Pat. Nos. 3,535,870 (Mitchell); 3,999,372; (Welch); 4,043,117 (Maresca); and 4,183,205 (Kaiser). Furthermore, these meters are subject to coin jams, vandalism, and exposure to the environment, all of which contribute to the need to service these meters. However, the design of these meters are not easily maintained, especially at the meter site. For example, to clear a coin jam, the entire internals of the parking meter have to be disassembled, the coin jam cleared and then the parking meter re-assembled. If the parking authority personnel do not have all of the proper tools, or if the location of the faulty meter is in an area that is not safe for the personnel to be disassembling the meter, the parking meter has to be sent to a maintenance location for service. This results in loss of revenue to the municipality until the meter is back in order.

In addition, with the advent of electronic parking meters, i.e., parking meters having internal electronics in a "parking meter mechanism" that include one or more of the following: LCDs (liquid crystal displays), LEDs (light emitting diode) indicators, electronic coin processors, electronic vehicle detection units, etc. For example, see U.S. Pat. Nos. 4,967,895 (Speas); 4,823,928 (Speas); 5,407,049 (Jacobs); 5,454,461 (Jacobs); 5,570,771 (Jacobs); and 5,642,119 (Jacobs); 5,442,348 (Mushell). However, such electronic parking meter mechanisms are not readily adapted for quick and easy maintenance in the field.

Therefore, there remains a need for an electronic parking meter mechanism that can be easily maintained and quickly-disassembled and re-assembled by parking authority personnel on the street and while not requiring any tools to accomplish the maintenance. In addition, there remains a need for a set of icon displays that can provide both the patron and the parking authority personnel with various electronic display icons that cover a range of parking meter conditions, especially where the parking meter includes a vehicle detecting apparatus.

OBJECTS OF THE INVENTION

Accordingly, it is the general object of this invention to provide an apparatus which addresses the aforementioned needs.

It is a further object of this invention to provide a parking meter mechanism that can be quickly dis-assembled.

It is yet another object of this invention to provide a parking meter mechanism that can be dis-assembled without the need for any tools.

It is still yet another object of this invention to provide a parking meter mechanism that can be dis-assembled in the field quickly without the need for tools.

It is yet another object of the present invention to provide a parking meter mechanism that utilizes a single icon on its display to indicate that a vehicle is presently being detected in the corresponding parking space.

It is still yet another object of the present invention to provide a parking meter mechanism that utilizes a single icon on its display to indicate that the vehicle-detecting apparatus has been tampered with.

It is still another object of the present invention to provide a parking meter mechanism that utilizes a single icon on its display to indicate that a detected vehicle is non-compliant, i.e., the detected vehicle has not yet paid.

It is even yet a further object of the present invention to provide a parking meter mechanism that utilizes a single icon on its display to indicate that a detected vehicle has completed its grace period without having fed the parking meter and is now eligible for a parking ticket.

It still yet even further another object of the present invention to provide a parking meter mechanism that utilizes a single icon, in combination with a numerical display, on its display to indicate an expired time amount indication of a detected vehicle.

It is still yet another object of the present invention to provide a parking meter mechanism that utilizes a single icon on its display to indicate that no parking is permitted when used in conjunction with a vehicle-detecting apparatus.

It is still another object of the present invention to provide a parking meter mechanism that utilizes a single icon on its display to indicate that an invalid coin was just deposited when used in conjunction with a vehicle-detecting apparatus.

It is still yet another object of the present invention to provide a parking meter mechanism that utilizes a single icon on its display to indicate that the maximum amount of parking time was purchased when used in conjunction with a vehicle-detecting apparatus.

It is still yet another object of the present invention to provide a parking meter mechanism that utilizes a single icon on its display to indicate that a coin jam has occurred when used in conjunction with a vehicle-detecting apparatus.

It is still yet another object of the present invention to provide a parking meter mechanism that utilizes a single icon on its display to indicate that an invalid card has been inserted into the parking meter when used in conjunction with a vehicle detecting apparatus.

It is yet a further object of the present invention to provide a parking meter mechanism that utilizes a single icon on its display to indicate a low battery condition is present when used in conjunction with a vehicle detecting apparatus.

SUMMARY OF THE INVENTION

These and other objects of the instant invention are achieved by providing a tool-less parking meter mechanism, adapted for use inside a parking meter housing. The tool-less parking meter mechanism comprises: (a) a first half; (b) a second half; (c) electronic circuitry disposed in one of the halves; and (d) securing mechanism (e.g., a pair of biasing mechanisms) for releasably securing said halves together, said securing mechanism requiring no tools to secure said halves together.

These and other objects of the instant invention are also achieved by providing an electronic parking meter mechanism, adapted for use inside a parking meter and whereby that electronic parking meter mechanism comprises: (a) an electronic display, visible to a patron through a lens in a cover of the parking meter; (b) electronics for controlling the display and for receiving vehicle detection data from a vehicle detecting apparatus; and (c) wherein the electronic display comprises a single icon (e.g., a silhouetted vehicle icon) for indicating that a vehicle is presently being detected.

These and other objects of the instant invention are also achieved by providing an electronic parking meter mechanism, adapted for use inside a parking meter and whereby that electronic parking meter mechanism comprises: (a) an electronic display, visible to a patron through a lens in a cover of the parking meter; (b) electronics for controlling the display and for receiving vehicle detection data from a vehicle detecting apparatus; and (c) wherein the electronic display comprises a single icon (e.g., a silhouetted vehicle icon having a horizontal bar over top of the icon) indicating that a detected vehicle has not yet paid the parking meter.

These and other objects of the instant invention are also achieved by providing an electronic parking meter mechanism, adapted for use inside a parking meter and whereby that electronic parking meter mechanism comprises: (a) an electronic display, visible to a patron through a lens in a cover of the parking meter; (b) electronics for controlling the display and for receiving vehicle detection data from a vehicle detecting apparatus; and (c) wherein the electronic display comprises a single icon (e.g., a lightning bolt-shaped icon) for indicating that the vehicle detecting apparatus has been tampered with.

These and other objects of the instant invention are also achieved by providing an electronic parking meter mechanism, adapted for use inside a parking meter and whereby that electronic parking meter mechanism comprises: (a) an electronic display, visible to a patron through a lens in a cover of the parking meter; (b) electronics for controlling the display and for receiving vehicle detection data from a vehicle detecting apparatus; and (c) wherein the electronic display comprises a single icon (e.g., an hourglass icon having only its lower portion filled) for indicating that a detected vehicle is eligible for a ticket.

These and other objects of the instant invention are also achieved by providing an electronic parking meter mechanism, adapted for use inside a parking meter and whereby that electronic parking meter mechanism comprises: (a) an electronic display, visible to a patron through a lens in a cover of the parking meter; (b) electronics for controlling the display and for receiving vehicle detection data from a vehicle detecting apparatus; and (c) wherein the electronic display comprises a single icon, in combination with a numerical display,(e.g., a "–" symbol in front of a seven segment display which provides a numerical representation of the amount of time that a vehicle has been parked at an expired meter) for indicating the amount of time that a vehicle has been parked at an expired meter.

DESCRIPTION OF THE DRAWINGS

Other objects and many of the attendant advantages of this invention will be readily appreciated as the same becomes better understood by reference to the following detailed description when considered in connection with the accompanying drawings wherein.

DESCRIPTION OF THE PREFERRED EMBODIMENT OF THE INVENTION

Figure 2:
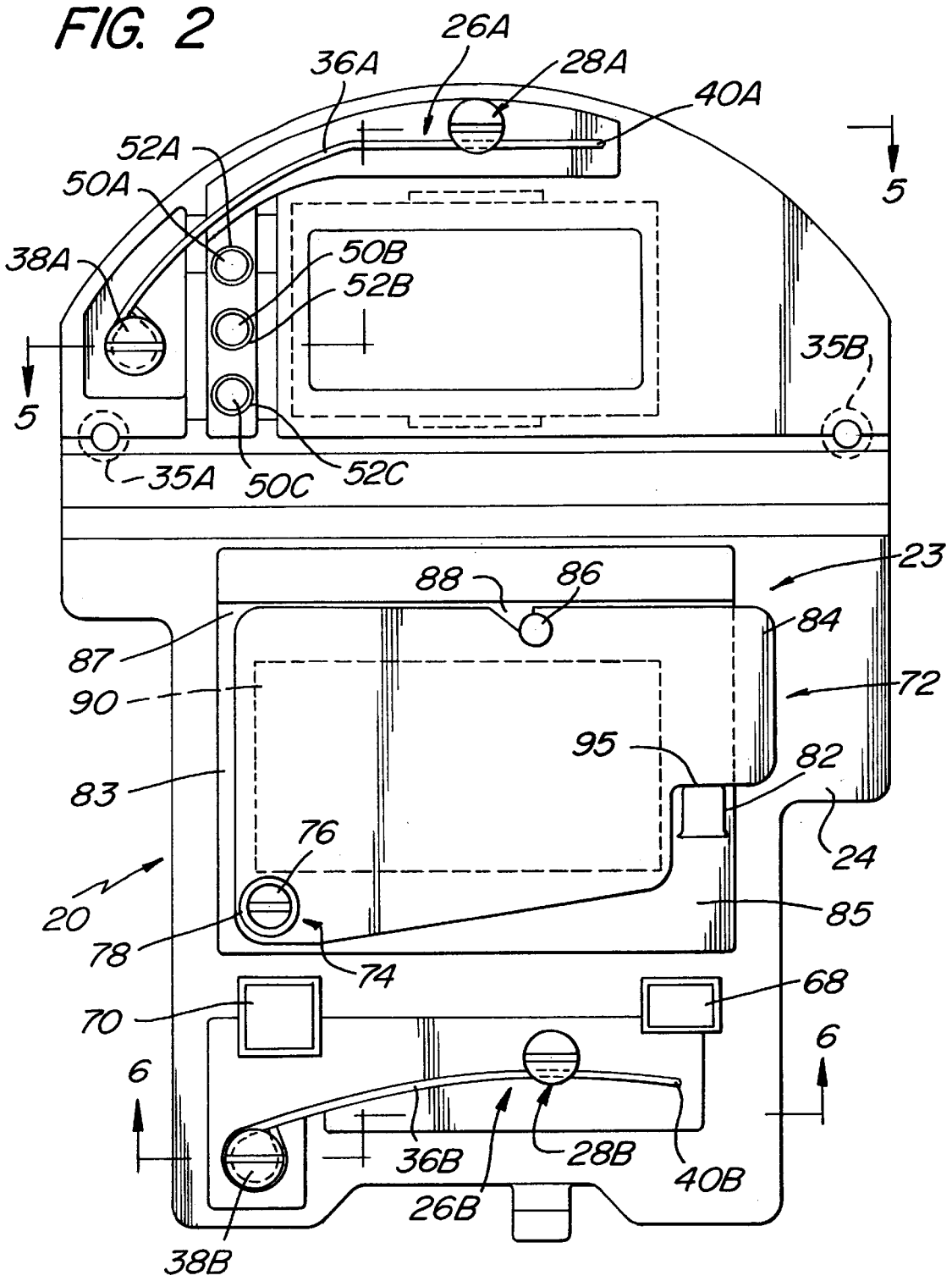
FIG. 2 is an enlarged rear (street-side) elevation view of the present invention.

Referring now in greater detail to the various figures of the drawing wherein like reference characters refer to like parts, a tool-less parking meter mechanism for parking meters constructed in accordance with the present invention is shown generally at 20 in FIG. 2.

Figure 1:
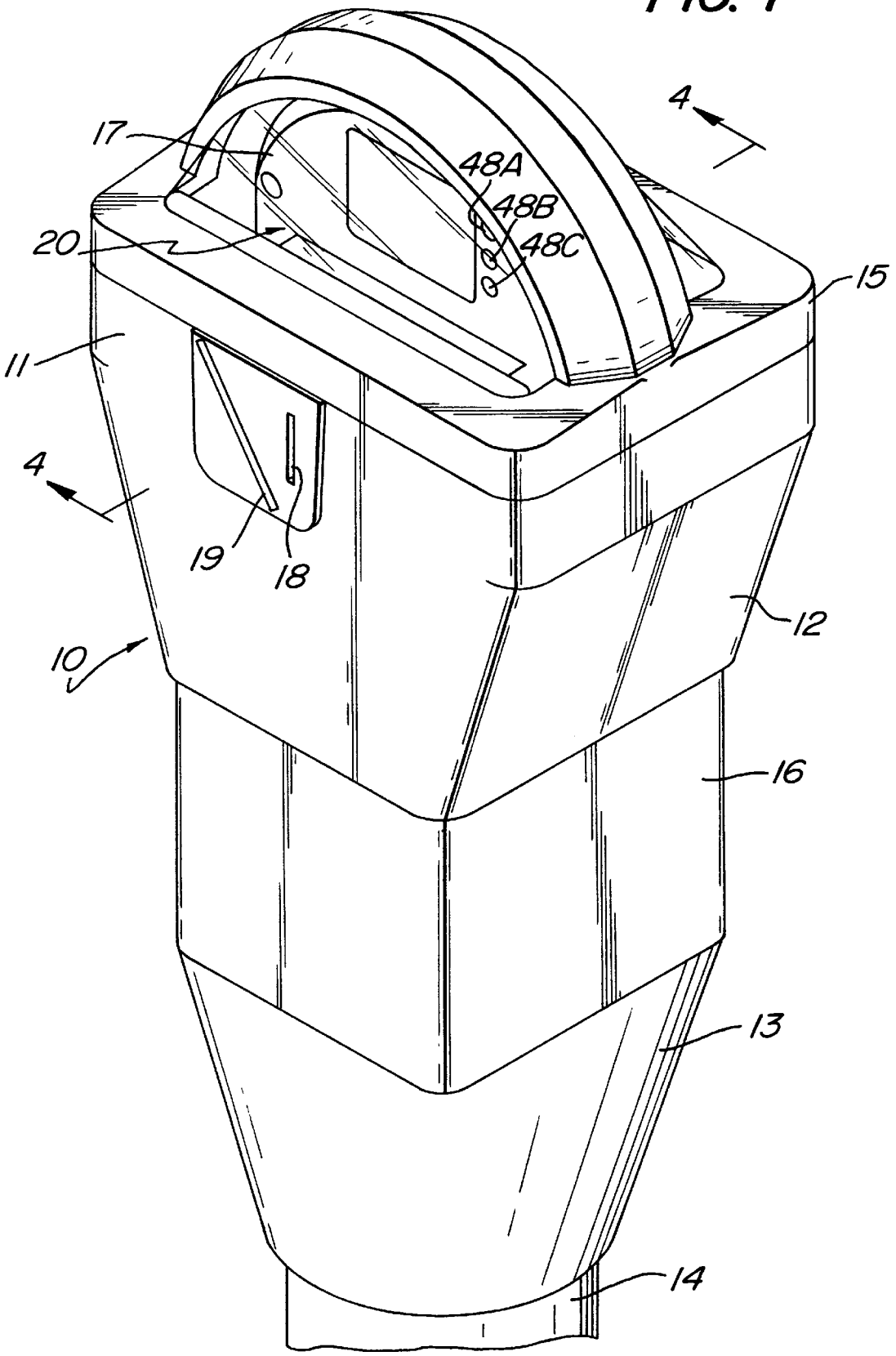
FIG. 1 is an isometric view of a tool-less parking meter mechanism installed in a parking meter.

The tool-less parking meter mechanism (TLPMM) 20 comprises the operative portion of a parking meter 10 (FIG. 1). As shown most clearly in FIG. 1, the parking meter 10 comprises a parking meter housing 12 that is supported at the parking space location (not shown) by a stanchion 14. The parking meter housing 12 is coupled to the stanchion 14 via a vault 13 (which receives the deposited coins) and a spacer 16. It should be understood that the parking meter housing 12 can be connected directly to the vault 13 (as are most conventional parking meters) without the spacer 16. The spacer 16 may comprise a vehicle detection unit, as well as other parking meter components, as set forth in application Ser. No. 08/731,096, now U.S. Pat. No. 5,852,411 (Jacobs et al.), which is incorporated by reference herein and is entitled Universal Adaptor for Electronic Parking Meters, which is assigned to same assignee as the present invention, namely Intelligent Devices, Inc. To install the TLPMM 20 into the parking meter 10, parking authority personnel remove the cover 15 of the parking meter housing 12. The TLPMM 20 is then positioned inside the housing, with the display 25 (to be discussed in detail later) being visible through the lens portion 17 of the cover 15, on the sidewalk-side 11 of the parking meter 10. A coin slot 18 and a parking card (e.g., a debit card, smart card, etc.) slot 19, also on the sidewalk-side 11 of the parking meter 10, are aligned with respective apertures (also to be discussed later) in the TLPMM 20. The cover 15 is then re-installed and secured to the housing 12.

The importance of the TLPMM 20 is that once it is removed from the parking meter housing 12, it can be dis-assembled, and later re-assembled, without the need for any tools, thereby allowing the parking meter mechanism to be quickly serviced on-the-spot (or swapped out with another TLPMM 20) and restoring the parking meter 10 into operation in the least amount of time. As a result, the parking meter housing 12, the vault 13, the stanchion 14, the cover 15 and the spacer 16 are not part of the patentable invention of this application.

Figure 3:
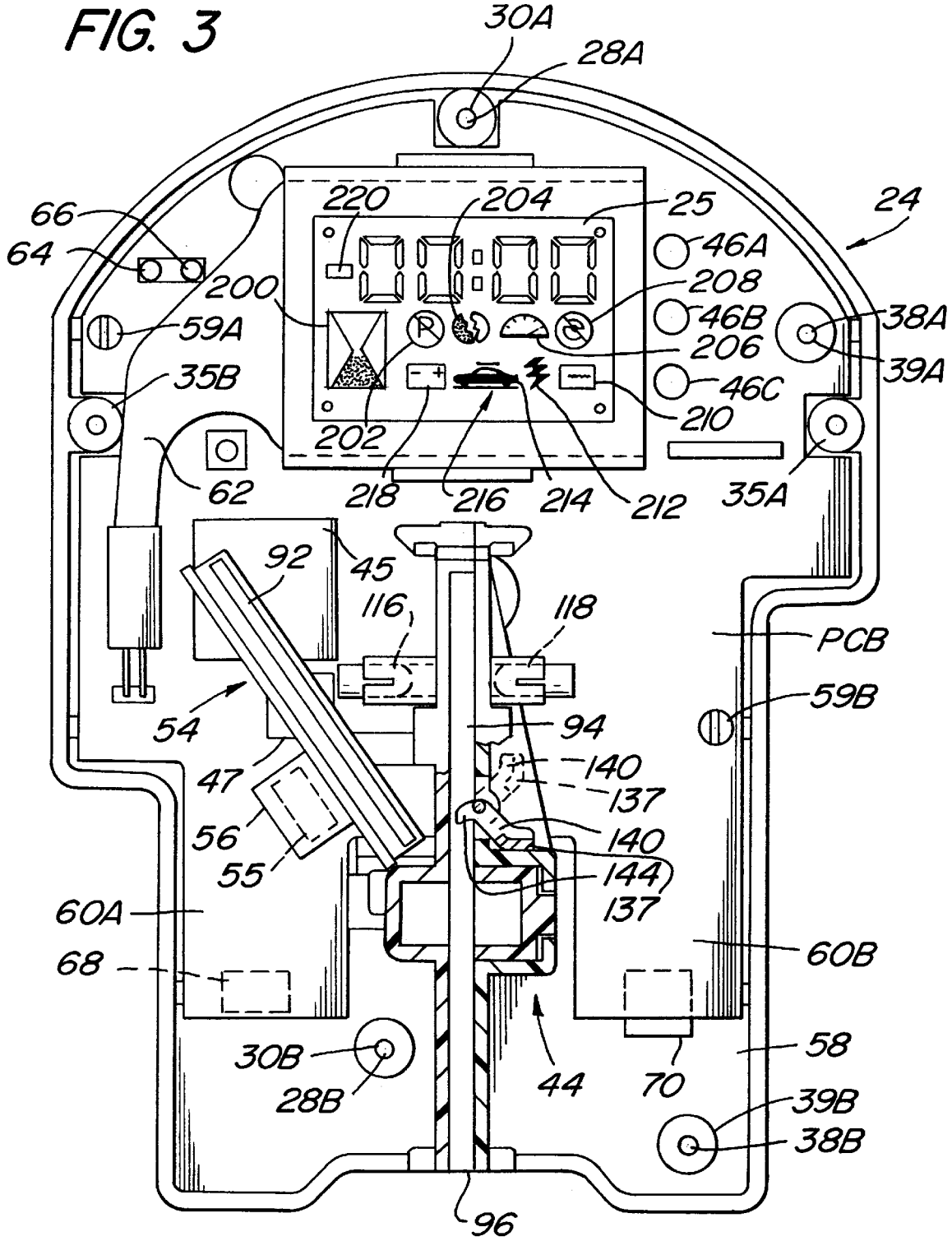
FIG. 3 is a front elevation view of the interior of the street-side half of the present invention showing a card reader in partial cross-section and showing the various icons for use on the parking meter display.
Figure 4:
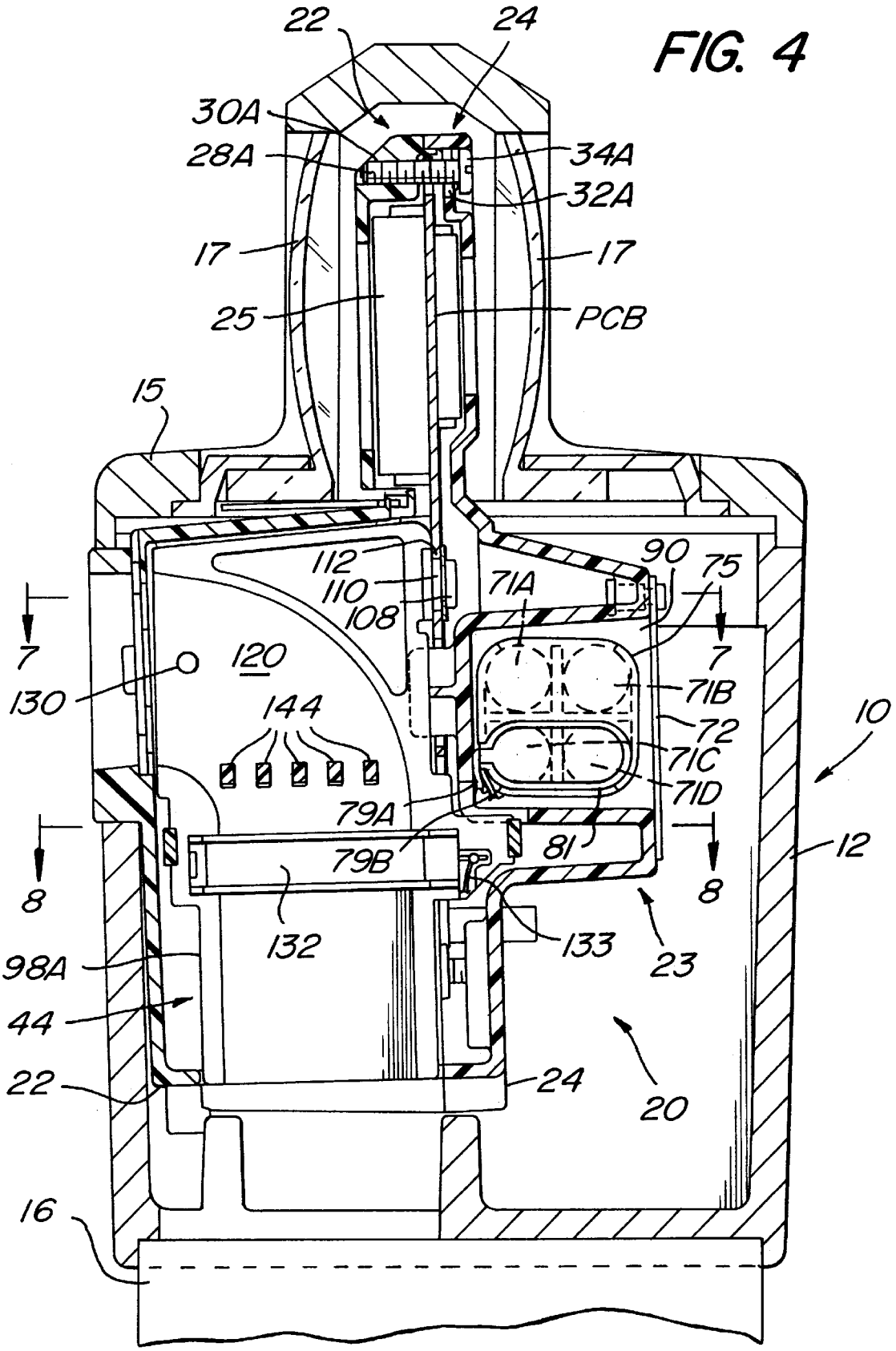
FIG. 4 is a cross-sectional view of the present invention installed in the parking meter.
Figure 5:
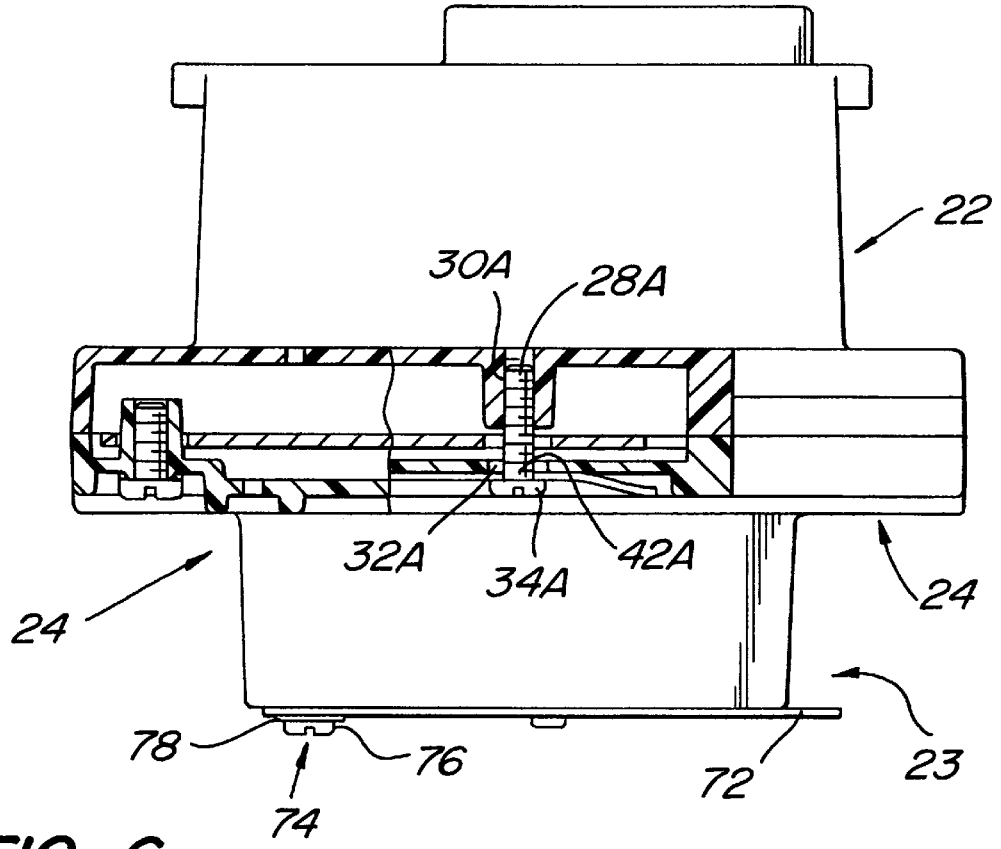
FIG. 5 is a cross-sectional view of the present invention taken along line 5—5 of FIG. 2.
Figure 6:
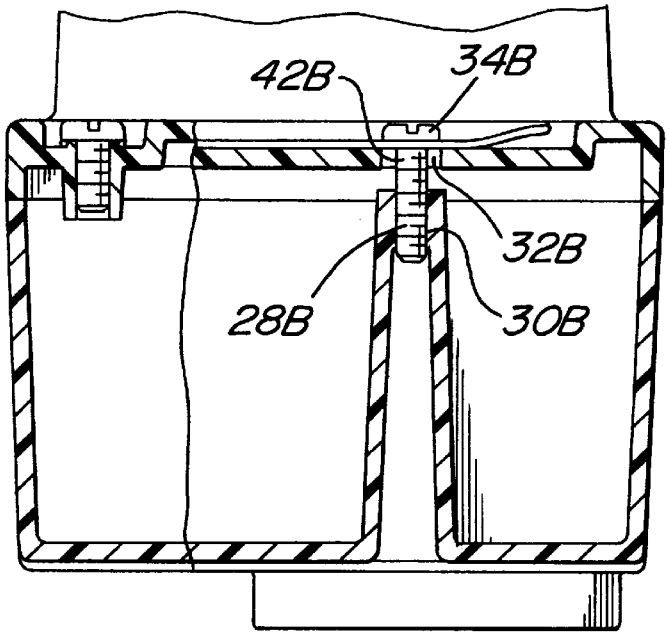
FIG. 6 is a cross-sectional view of the present invention taken along line 6—6 of FIG. 2.

The TLPMM 20 comprises a sidewalk-side half 22 and a street-side half 24, as shown in FIG. 4. A battery compartment 23, as will be discussed in detail later, forms a portion of the street-side half 24. The two halves 22/24 are releasably secured to each other via a tool-less securing mechanism, which in the preferred embodiment, comprises an upper biasing mechanism 26A (FIG. 2) and a lower biasing mechanism 26B (FIG. 2) which are located on the street-side half 24, as shown most clearly in FIG. 2. Each biasing mechanism comprises a respective screw 28A/28B that is threadedly secured into a respective bore 30A/30B (FIGS. 5–6) in the sidewalk-side half 22 of the TPLMM 20. A respective opening 32A/32B (FIG. 4) in the street-side half 24 allows the respective head 34A/34B of the respective screw 28A/28B to pass therethrough. A respective retention wire 36A/36B (FIG. 2) is secured under the head of another screw 38A/38, each of which is threadedly engaged in respective bores 39A/39B (FIG. 3) in the street-side half 24. When the free end 40A/40B of the retention wires 36A/36B is biased against the shank 42A/42B of the screw 28A/28B and under the head 34A/34B, the two halves 22 and 24 are secured against each other. To separate the two halves 22 and 24, the parking authority personnel downwardly depresses the free ends 40A/40B of the retention wires 36A/36B so that the free ends 40A/40B clear the screw heads 34A/34B, thereby freeing the street-side half 24 by allowing the openings 32A/32B to pass over the screw heads 34A/34B. Conversely, in order to re-assemble the TLPMM 20, the reverse process is used. To facilitate re-assembly, alignment bosses 35A and 35B (FIGS. 2–3) are received in corresponding sleeves (not shown) in the interior of the sidewalk-side half 22.

It is within the broadest scope of this invention to include many other tool-less securing mechanisms that are known to those skilled in the art, such as threaded fasteners or captured post ends, and their equivalents, that can be manually-operated without the use of tools. For example, an alternative embodiment (not shown) of the tool-less securing mechanism may include a post that is fixedly secured to the interior of one half (22 or 24) and whereby this post protrudes through the other half (24 or 22) when the halves 22/24 are placed together. A free end of this post, which passes through this other half (24 or 22) is threaded. A threaded fastener (e.g., a knurled end cap having a threaded interior) then can be threadedly engaged with the threaded end of the post to releasably secure the halves 22/24 together. This tool-less securing mechanism may include such a post in the upper portions of the halves 22/24 and another post in the lower portions of the halves 22/24. Thus, to dis-assemble the TLPMM 20, the user would simply unscrew the threaded fastener and pull the halves 22/24 apart; reversing this process would permit the user to re-assemble the TLPMM 20 without having to use any tools. Alternatively, another type of tool-less securing mechanism (also not shown) may include a post that is also fixedly secured to the interior of one half (22 or 24) that protrudes through the other half (24 or 22) when the halves are placed together and which protrudes through the battery compartment 23 (to be discussed later) forming a free end. A pivoting cover plate 72 (also discussed later) would act not only as an access door to the batteries (also to be discussed later) in the battery compartment 23, but would also include an aperture therein to capture a free end of the post, thereby securing the halves 22/24 together. To disassemble the TLPMM 20, the user would swing the cover plate 72 away from the post and then pull the halves 22/24 apart; reversing this process would permit the user to re-assemble the TLPMM 20, again, without having to use any tools. Thus, the broad concept of the present invention includes all types of securing mechanisms that require no tools for dis-assembling the halves 22/24 and re-assembling the halves 22/24 and is therefore not limited to the preferred embodiment.

As shown most clearly in FIG. 3, with the two halves 22/24 dis-assembled, the operative portion of TLPMM 20 resides inside the street-side half 24 of the TLPMM 20. A printed circuit board (hereinafter, "PCB", only the outline of which is shown) contains the majority of the TLPMM electronics and to which a LCD display 25 is electrically coupled at the top. An electronic card reader 54, via an associated PCB connector 56, plugs into the PCB. A coin acceptor 44 is releasably secured in an orthogonal orientation (FIG. 7) to the PCB, as will be discussed later. The PCB comprises a pair of extensions 60A and 60B that fit around the coin acceptor 44.

As shown in FIG. 3, the majority of the PCB conforms to the shape of the interior of the street-side half 24 and is positioned therein. The PCB itself is not meant to be serviced in the field and, as a result, the PCB is secured to the interior surface 58 of the street-side half 24 by screws 59A and 59B. A microcomputer 45 is electrically coupled to the PCB for controlling electronic parking meter operation. A master clock 47 (e.g., another microcomputer) is also electrically coupled to the PCB for providing the proper synchronization to the electronic parking meter operation. Three LEDs 46A, 46B and 46C on the PCB are used for indicating various parking meter conditions and are visible through respective openings 48A–48C (FIG. 1) in the PCB board on the sidewalk side of the meter 10. Another set of three LEDs 50A–50C (FIG. 2) work in conjunction with the LEDs 46A–46C and are visible through respective openings 52A–52C (FIG. 2) on the street side of the meter 10. The LCD display 25 is electrically coupled to the PCB through a wire harness 62 (FIG. 3). An IR (infrared) detector 64 and emitter 66 are electronically coupled to the PCB and are used in conjunction with a parking authority hand-held communication unit (not shown). On the back side of the PCB is a test port electrical connector 68 and a vehicle detector electrical connector 70 (FIG. 3), each of which are accessible on the street side half 24 (FIG. 2). The test port connector 68 permits the parking authority to quickly monitor/test the electronics once the TLPMM 20 is removed from the housing 12. A wire harness (not shown) couples the vehicle detector connector 70 to an electrical connector (not shown) on a PCB board (also not shown) inside the spacer 16, thereby providing vehicle detection information to the electronics on the PCB of the TLPMM 20.

Figure 4A:
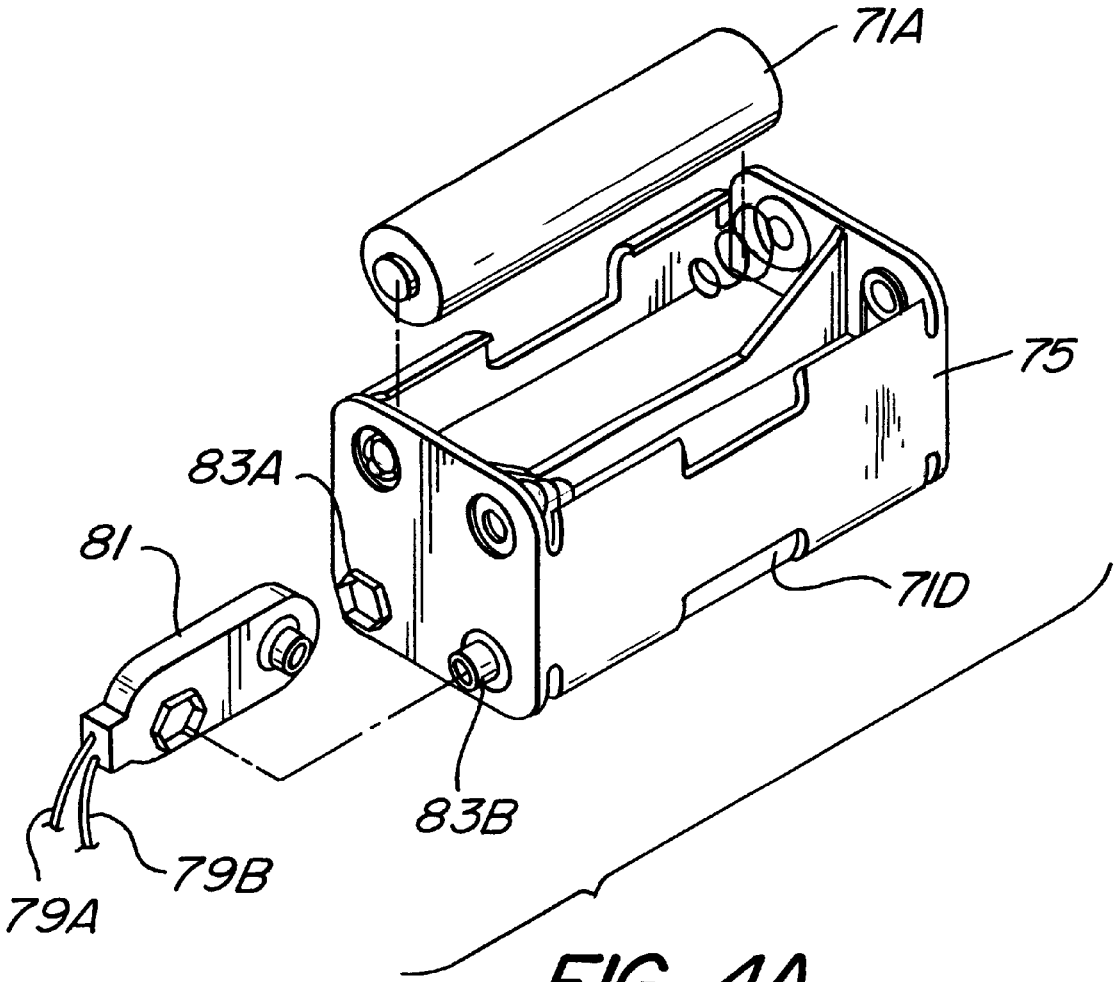
FIG. 4A is exploded isometric view of a battery holder and electrical connector used in the present invention.

The electronics on the PCB (as well as the electronics in the spacer 16) are powered by four M batteries 71A–71D (1.5 VDC/battery), as shown in FIG. 4, that are positioned inside the battery compartment 23. Access to the batteries is through a pivoting cover plate 72. When the cover plate 72 is pivoted away (discussed in detail below), the user can remove a battery holder 75 (FIG. 4A) from the battery compartment 23 and then replace all of the batteries. A pair of wires 79A/79B are hard-wired to the electronics at one end (not shown) and comprise a conventional battery connector 81 at their other ends (FIG. 4A) that mates with corresponding electrical terminals 83A/83B on the battery holder 75.

Figure 7:
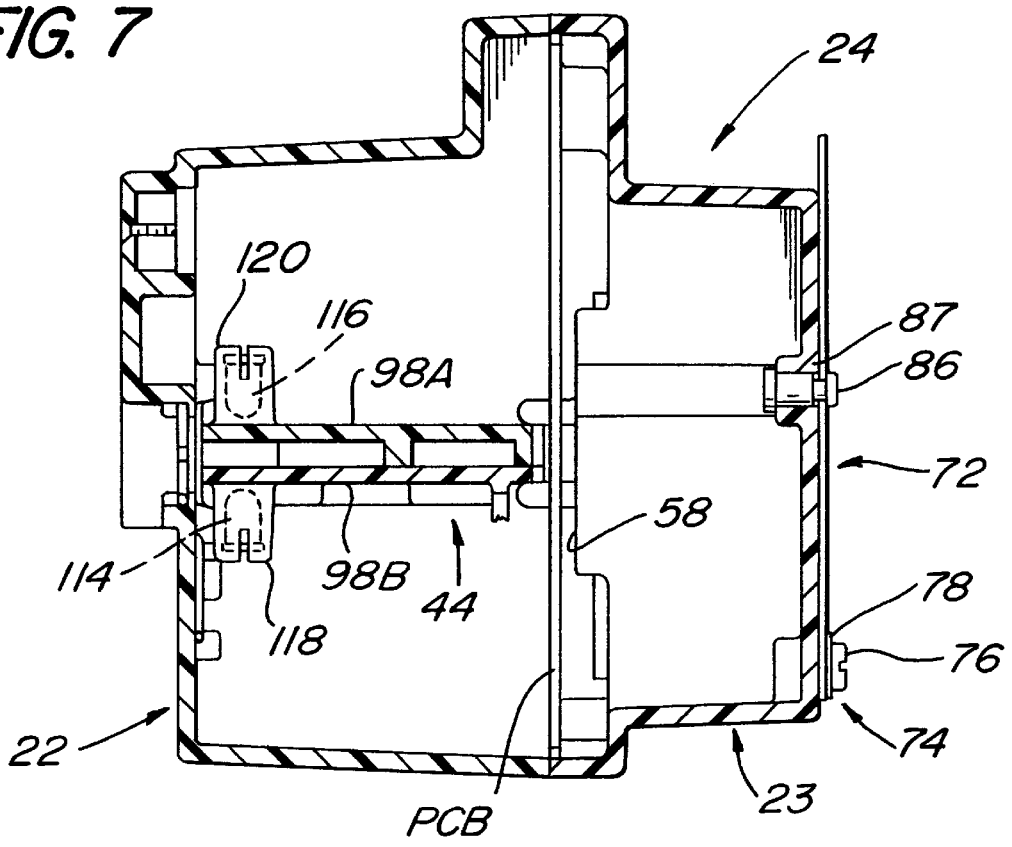
FIG. 7 is a cross-sectional view of the present invention taken along line 7—7 of FIG. 4.
Figure 8:
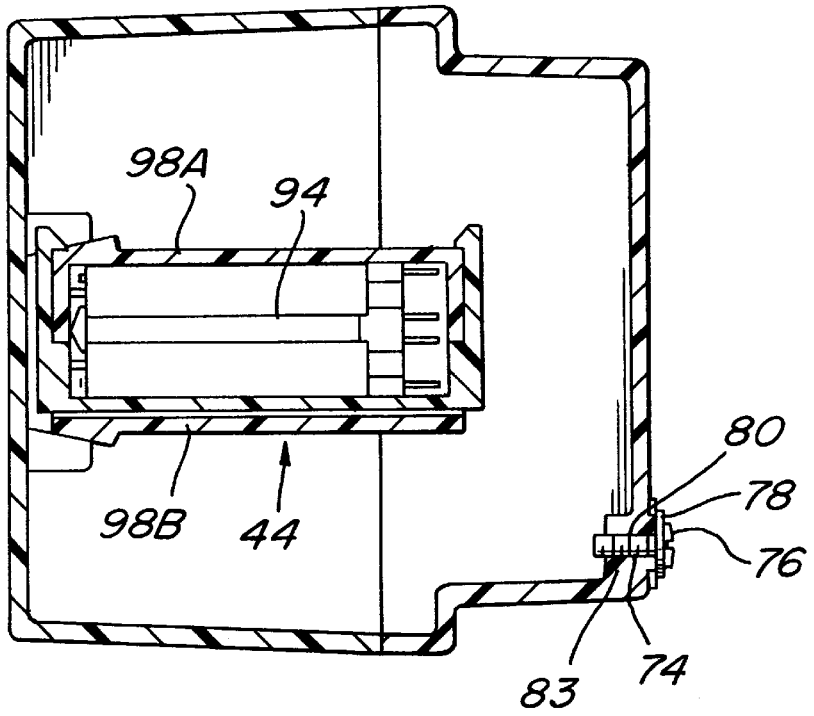
FIG. 8 is a cross-sectional view of the present invention taken along line 8—8 of FIG. 4.

As shown in FIG. 2, the battery compartment cover plate 72 is pivotally coupled to the battery compartment 23 via a screw 74 that is threadedly engaged in a bore 80 (FIG. 8) in a side frame wall 83 of the battery compartment 23. A screw head 76 traps a washer 78 against the plate 72. A latch member 82 is provided on another side frame wall 85 and juts upward out of the plane of FIG. 2. A bottom edge 95 of an extension 84 of the cover plate 72 maintains the plate 72 so that the battery compartment 23 is closed. Furthermore, when the cover plate 72 is in a closed position (as shown in FIG. 2) a screw 86, fixedly secured into an upper frame wall 87 is inserted into a slot 88 in the upper edge of the cover plate 72 to act as an upward stop (FIG. 7). To open the cover plate 72, the parking authority personnel pulls the extension 84 slightly outward (i.e., out of the plane of FIG. 2) and then pivots the extension 84 downward in a clockwise motion, thereby exposing the battery holder 75 located in the recess 90. As discussed previously, the batteries 71A–71D can then be removed and replaced with new batteries, the battery holder 75 re-inserted into the recess 90, and the cover plate 72 closed using a procedure reversed to the opening procedure.

As can be seen most clearly in FIG. 3, the electronic card reader 54 comprises a slot opening 92 and the coin acceptor 44 comprises a slot opening 94. When the two halves 22/24 are assembled and the TLPMM 20 positioned inside the housing 12, the card reader slot opening 92 and the coin acceptor slot opening 94 are aligned with card slot 19 and coin slot 18, respectively. Furthermore, when the TLPMM 20 is positioned inside the housing 12, the bottom opening 96 (FIG. 3) of the coin acceptor slot opening 94 is aligned with the opening (not shown) to the vault 13. Where the spacer 16 is also utilized, there is an opening in the interior of the spacer 16 that permits a coin that passes through the opening 96 to pass through the spacer 16 and enter into the opening of the vault 13.

Figure 9:
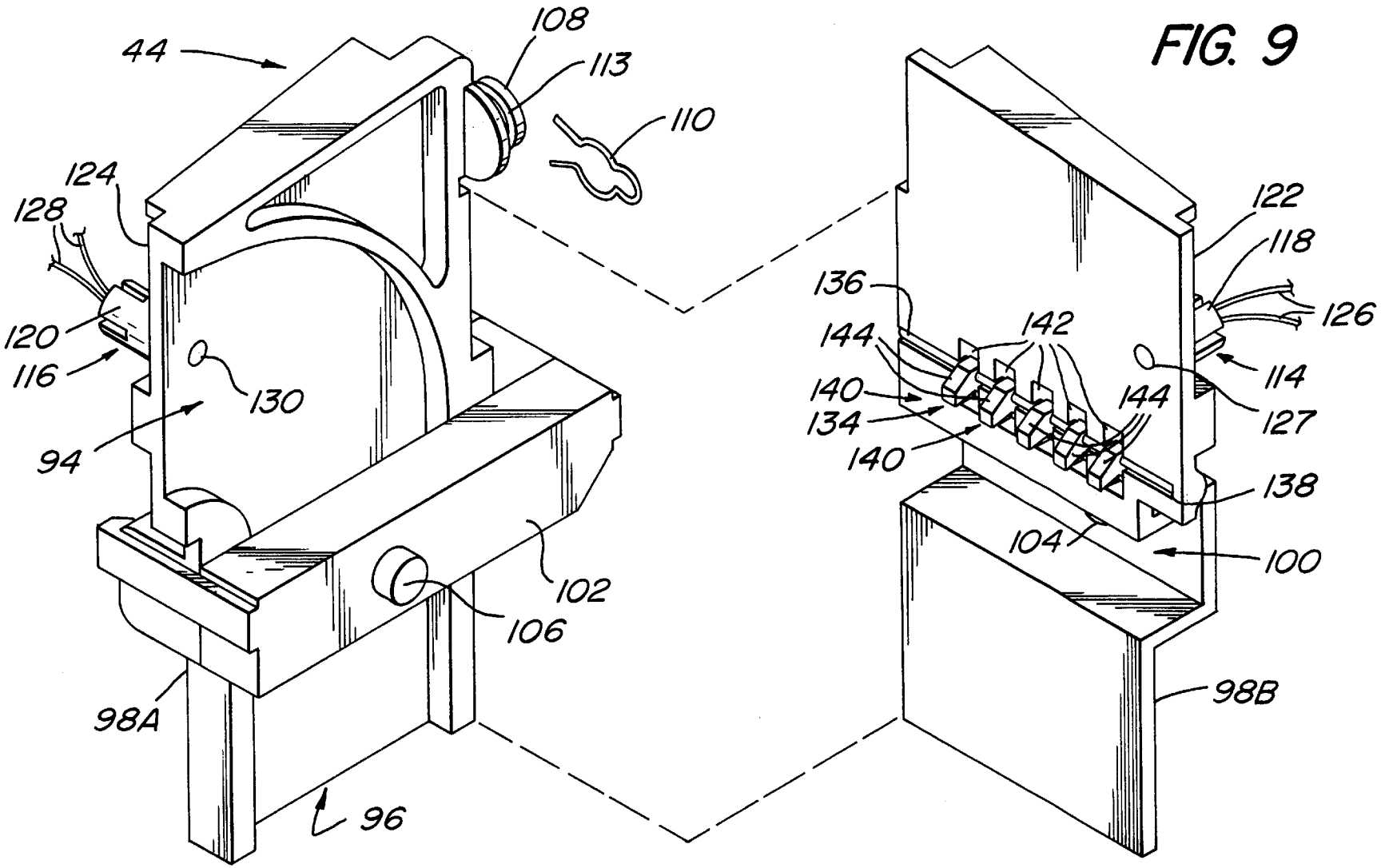
FIG. 9 is an exploded isometric view of a coin acceptor used in the present invention.

To effect a quick clearance of a coin jam, as shown most clearly in FIG. 9, the coin acceptor 44 basically comprises two parts: a left section 98A and a right section 98B. These two sections 98A/98B are releasably secured to each other using a friction fit at their respective mid-sections. In particular, the right section 98B comprises a channel 100 that friction fits over a boss 102 of the left section 98A and, in addition, an aperture 104 in the right section 98B captures an alignment hub 106 in the left section 98B. When the two sections 98A/98B are secured together the entire coin acceptor 44 is releasably secured to the PCB via a mounting plug 108 and a retaining ring 110. The mounting plug 108, located on the top of the left section 98A, passes through a hole 112 (FIG. 4) in the PCB and the retaining ring 110 is then pressed into a channel 113 (FIGS. 11–12) in the mounting plug 108 in close contact with the PCB, thereby securing the coin acceptor 44 to the PCB.

Figure 10:
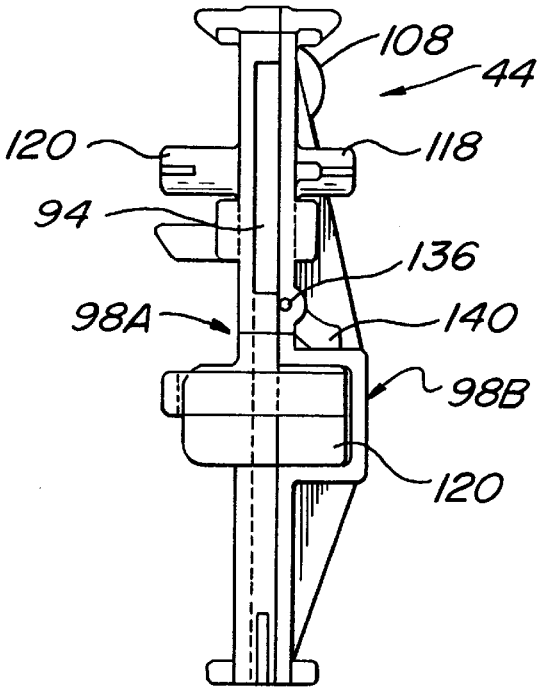
FIG. 10 is an elevated front view of the coin acceptor.
Figure 11:
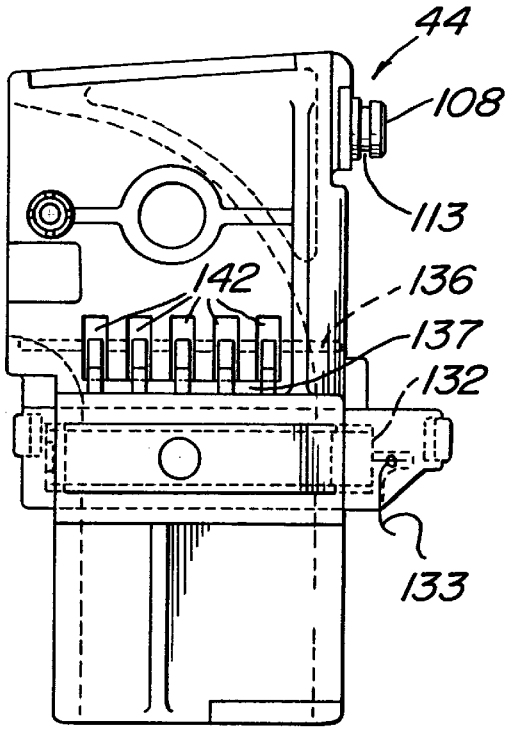
FIG. 11 is a side elevation view of the coin acceptor.
Figure 12:
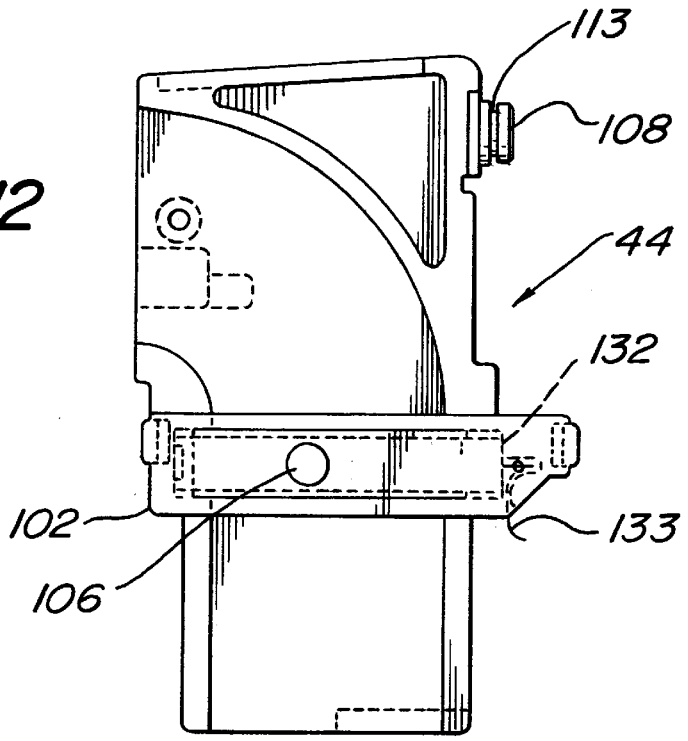
FIG. 12 is a side elevation view of the interior of the left portion of the coin acceptor.

With the coin acceptor 44 assembled (FIG. 10), the coin detector 44 detects the presence of the coin, determines whether it is an invalid coin (e.g., a slug), its denomination and the existence of coin jam. These coin characteristics are detected by sensors that are internal to the coin acceptor 44. As can be seen most clearly in FIGS. 7 and 9, the right section 98B comprises a coin emitter sensor 114 and the left section 98A comprises a coin detector sensor 116. Each of these sensors comprises a respective housing 118/120 which forms a friction fit into a respective wall 122 and 124, thereby permitting each sensor housing to be disengaged from the respective walls, if required. Each sensor 114/116 has a respective pair of wires 126 and 128 that electrically couple (not shown) the sensors to the PCB. The coin emitter sensor 114 transmits a signal (e.g., short pulses) through an aperture 127 in the wall 122 which is normally detected by the coin detector sensor 116 through an aperture 130 in the wall 124. A coin passing between these apertures during descent through the coin slot 94 interrupts this signal, thereby alerting the microcomputer 45 to begin the coin detection process. In addition, inside the boss 102 there is another coin sensor 132 (FIGS. 11–12) for effecting coin discrimination/validity as the coin passes closely adjacent the boss 102 during descent. The coin sensor 132 is also electrically coupled to the PCB via wires 133 (FIGS. 11–12).

The coin acceptor 44 also includes an anti-theft mechanism 134 that is housed just above the channel 100 in the right section 98B. The anti-theft mechanism 134 prevents someone from trying to retrieve a coin that has been deposited into the coin slot 18 and partially down the coin acceptor slot opening 94. In particular, the anti-theft mechanism 134 comprises a rod 136 journaled at its ends inside a recess 138 in the wall 122 just above the channel 100. A plurality of projections 140 are fixedly secured to the rod 136 such that when the rod 136 rotates all of the projections rotate in unison. In addition, as can be seen most clearly in FIG. 11, each of the projections 140 are physically connected to a common member 137 which acts a weight to restore the projections to their normal position (as shown in FIG. 9), as will be discussed below. Each of the projections 140 is positioned inside a respective aperture 142. Before a coin is deposited into the coin slot 18, the projections 140 are disposed in the position shown in FIG. 9, with a coin-blocking end 144 positioned in the slot 94 (FIG. 3 illustrates one projection 140 disposed in the slot 94). When the coin (not shown) impacts the coin-blocking end 144 of the projections 140, the coin-blocking ends 144 are driven downward to allow the coin to pass; this downward motion rotates the rod 136 and causes the common member 137 to momentarily assume the position shown in phantom in FIG. 3. Once the coin passes, the weight of the common member 137 rotates the rod 136 in the opposite direction, thereby restoring the projections 140 so that their coin-blocking ends 144 are once again positioned in the slot 94 and thereby blocking any attempt to retrieve the coin upward, back through the slot 94.

As stated previously, the card reader 54 comprises an electrical connector 56 (FIG. 3) that couples to a corresponding electrical connector 55 on the PCB. This electrical connector 56 also physically couples the card reader 54 to the PCB. Thus, if required by parking authority personnel, the card reader 54 can be quickly and easily disconnected from the PCB and re-installed or replaced with another card reader.

As mentioned earlier, in FIG. 3, there is shown various icons on the parking meter display. These are controlled by the electronics of the PCB of the TLPMM 20 and are displayed whenever the respective condition(s) occur that they are to indicate. In particular, where a vehicle detecting apparatus (e.g., included in the spacer 16 discussed earlier) is used in conjunction with the TLPMM 20, the TLPMM 20 can provide both the parking authority personnel and patrons with the following indications on the display 25: (1) a vehicle detected indication; (2) a non-compliance condition (see below); (3) a "ticketeligible" indication; and (4) an indication as to how long a detected vehicle has been at the expired meter. Furthermore, where the vehicle detecting apparatus further comprises a tamper-evident subsystem, a "tampered" condition can also be indicated. As a result, other than the seven segment displays used in the display 25 (FIG. 3), none of the following indications/icons are taught or suggested in the parking meter prior art:

A "vehicle detected" indication 214 is depicted by a silhouetted vehicle which indicates that the meter is presently detecting a vehicle.

A "non-compliance" indication 216 is depicted by the silhouetted vehicle icon accompanied with a horizontal line over the top of the vehicle. This indicator alerts the parking authority personnel that a detected vehicle has not yet paid.

A "ticket-eligible" indication 200 is depicted by an hourglass having its lower portion filled. This provides an indication that the detected vehicle is ticket eligible, i.e., any expired grace period has elapsed. In particular, in many municipalities, the parking authority grants a grace period (e.g., 5 minutes following an expired meter condition) to the patron. If the patron fails to feed the meter during the grace period, at the end of the grace period the meter will provide "violation" condition and a parking ticket will be issued. Where there is no vehicle detection used in conjunction with the parking meter, if the vehicle were to leave the parking space at only 3 minutes into the grace period, the parking meter would continue to count down to 5 minutes before resetting, thereby making the unoccupied parking space unusable until after the full grace period was completed. In contradistinction, when the TLPMM 20 is used in conjunction with the vehicle detecting apparatus, if that same situation occurred, i.e., where the patron left at 3 minutes into the grace period, the TLPMM 20 would automatically reset the parking meter to zero, as soon as the vehicle departed, without having to count down the full grace period. Thus, the "ticket-eligible" indication 200 provides an indication that a detected vehicle has exceeded the grace period and is now eligible for a parking ticket.

An "expired time" indication 220 comprises a minus sign ("–") in front of the seven segment displays in combination with the seven segment displays. This combination provides an indication to the parking authority personnel as to how long the meter has been expired.

A "ightning" bolt indication 212 indicates that the vehicle detecting apparatus (e.g., in the spacer 16) has been tampered with.

In combination with these unique indications/icons, the display 25 also includes the following indications/icons:

A "no-parking" indication 202 is depicted by an "P" enclosed in a circle with a diagonal line placed on top of the "P". This alerts patrons that no parking is allowed at this meter.

An "invalid coin" indication 204 is depicted by a severed coin design.

A "maximum-time-purchased" 206 indication is depicted by a semi-circular shape having graduations, imitating the old-style analog parking meter dials, with the arrow at the maximum parking time bought position.

A "coin jam" indication 208 is depicted by a circle having a diagonal line therethrough with unequal portions of semi-circles on each side of the diagonal line.

An "invalid card" indication 210 is depicted by a rectangle having a horizontal line therein. This indicates that the card inserted into the parking meter's debit (or smart) card slot 19 is invalid.

A "low battery" indication 218 is depicted by a rectangle having a "+" and "–", terminal inside a rectangle.

Without further elaboration, the foregoing will so fully illustrate my invention that others may, by applying current or future knowledge, readily the same for use under various conditions of service.

I claim:

1. A tool-less electronic parking meter mechanism, adapted for use inside a parking meter housing, said tool-less electronic parking meter mechanism comprising:

(a) a first half;

(b) a second half;

(c) electronic circuitry disposed in one of said halves; and (d) securing mechanism for releasably securing said halves together, said securing mechanism requiring no tools to secure said halves together.

2. The tool-less electronic parking meter mechanism of claim 1 wherein said securing mechanism comprises a pair of biasing mechanisms, each of said biasing mechanisms comprising:

(a) a post secured at one end into a facing surface of one of said halves and comprising a retaining surface at its other end;

(b) a corresponding aperture in the other of said halves; and (c) a retention wire, fixedly secured at one end to said other of said halves, and having a free end that is biased against a shank of said post and against said retaining surface when said retaining surface passes through said aperture.

3. The tool-less electronic parking meter mechanism of claim 1 further comprising a coin acceptor electrically connected to said electronic circuitry, said coin acceptor comprising:

(a) a first portion;

(b) a second portion;

(c) said first portion and said second portion comprising respective coin sensors that are electrically coupled to said electronic circuitry; and (d) said first portion and said second portion forming a coin slot when said portions are releasably secured to each other, said first portion and said second portion being releasably secured to each other through a friction fit.

4. The tool-less electronic parking meter mechanism of claim 3 wherein said first portion comprises a mounting member, said mounting member being positioned in a hole in a printed circuit board containing said electronic circuitry and wherein a retaining ring is pressed over said mounting member in close proximity to said printed circuit board to releasably secure said coin acceptor to said electronic circuitry.

5. The tool-less electronic parking meter mechanism of claim 3 wherein said first portion comprises a boss on said first portion and wherein said second portion comprises a channel on said second portion, said boss being received in said channel to form said friction fit to releasably secure said first portion to said second portion.

6. The tool-less electronic parking meter mechanism of claim 5 wherein said boss is positioned at a mid-section of said first portion and said channel is positioned at a corresponding mid-section of said second portion.

7. The tool-less electronic parking meter mechanism of claim 5 wherein said boss comprises an alignment hub and wherein said channel comprises an alignment aperture for receiving said alignment hub.

8. The tool-less parking meter mechanism of claim 1 further comprising a card reader coupled to said electronic circuitry, said card reader comprising an electrical connector that couples to a corresponding electrical connector on a printed circuit board containing said electronic circuitry.

* * * * *